US009923258B2

(12) United States Patent
Fahmi

(10) Patent No.: US 9,923,258 B2
(45) Date of Patent: Mar. 20, 2018

(54) WAVEGUIDE COMBINER APPARATUS AND METHOD

(71) Applicant: NANOWAVE TECHNOLOGIES INC., Etobicoke (CA)

(72) Inventor: Mohamed Mohamed Fahmi, Oakville (CA)

(73) Assignee: Nanowave Technologies Inc., Etobicoke (CA)

( * ) Notice: Subject to any disclaimer, the term of this patent is extended or adjusted under 35 U.S.C. 154(b) by 29 days.

(21) Appl. No.: 14/893,380

(22) PCT Filed: May 23, 2014

(86) PCT No.: PCT/CA2014/050481
§ 371 (c)(1),
(2) Date: Nov. 23, 2015

(87) PCT Pub. No.: WO2014/186900
PCT Pub. Date: Nov. 27, 2014

(65) Prior Publication Data

US 2016/0111767 A1 Apr. 21, 2016

Related U.S. Application Data

(60) Provisional application No. 61/826,699, filed on May 23, 2013.

(51) Int. Cl.
*H01P 5/12* (2006.01)

(52) U.S. Cl.
CPC ..... *H01P 5/12* (2013.01)

(58) Field of Classification Search
CPC ..... H01P 5/12; H01P 5/02; H01P 3/06; H01P 5/183

(Continued)

(56) References Cited

U.S. PATENT DOCUMENTS 2,568,090 A 9/1951 Riblet
2,585,173 A 2/1952 Riblet (Continued)

OTHER PUBLICATIONS

Ding et al., "Printed Dual-Layer Three-Way Directional Coupler Utilized as 3×3 Beamforming Network for Orthogonal Three-Beam Antenna Array", IEEE Antennas and Wireless Propagation Letters, vol. 13, May 7, 2014, pp. 911-914.

(Continued)

*Primary Examiner* — Robert J Pascal
*Assistant Examiner* — Kimberly Glenn
(74) *Attorney, Agent, or Firm* — Borden Ladner Gervais LLP

(57) ABSTRACT

Embodiments disclosed herein relate to wave guide couplers as well as 3-way, 6-way, and 9-way combiners. The waveguide coupler comprises: a housing having a first outer waveguide branch, a second outer waveguide branch, and an inner waveguide branch; first, second, and third input ports in communication with the first outer, second outer, and the inner waveguide branches respectively; an output port in communication with the inner waveguide branch; a first wall separating the first outer waveguide branch and the inner waveguide branch, the first wall having a first iris; a second wall separating the second outer waveguide branch and the inner waveguide branch, the second wall having a second iris; a first tapered section in the first outer waveguide branch; and a second tapered section the second outer waveguide branch. Various embodiments of the 3-way, 6-way, and 9-way combiners are implemented using the wave guide coupler.

19 Claims, 14 Drawing Sheets

(58) Field of Classification Search
USPC ..... 333/125, 127, 137
See application file for complete search history.

(56) References Cited

U.S. PATENT DOCUMENTS

| | | | |
|---|---|---|---|
| 5,892,414 | A | 4/1999 | Doughty et al. |
| 6,411,174 | B1 | 6/2002 | Crouch et al. |
| 2007/0063791 | A1 | 3/2007 | Wu et al. |
| 2009/0303145 | A1 | 12/2009 | Shijo et al. |
| 2012/0062335 | A1 | 3/2012 | Sherrer et al. |
| 2013/0141186 | A1 | 6/2013 | Nguyen et al. |

OTHER PUBLICATIONS

Balleyguier et al., "Design of RF Power Input Ports for IPHI RFQ", Proceedings of EPAC, Jun. 2002, Paris, France, pp. 2124-2126.
International Patent Application No. PCT/CA2014/050481, International Search Report dated Jul. 22, 2014.
Canadian Office Action for Canadian Patent Application No. 2912799, dated Sep. 15, 2016.
Written Opinion for International Patent Application No. PCT/CA2014/050481, dated Jul. 22, 2014, 5 pages.
International Patent Application No. PCT/CA2014/050481, IPRP Chapter I dated Dec. 3, 2015.
European Application No. 14801238.8, Extended European Search Report dated Dec. 21, 2016.
Canadian Patent Application No. 2912799, Office Action dated May 18, 2017.

WAVEGUIDE COMBINER APPARATUS AND METHOD

CROSS REFERENCE TO RELATED APPLICATIONS

The present application is a National Phase Entry of International Patent Application Serial No. PCT/CA2014/050481 filed May 23, 2014, which claims the benefit of priority of U.S. Provisional Patent Application No. 61/826,699 filed May 23, 2013, the contents of which are incorporated herein by reference.

FIELD

The present disclosure relates to microwave low loss, high power combiners used in microwave power sources and radio-frequency/microwave transmitter systems. In particular, embodiments disclosed herein relate to the realization of 3-way, 6-way and 9-way waveguide power combiners.

BACKGROUND

Power combiners are an essential part in the design of high power microwave and millimeter wave sources used in RADAR and telecommunication systems. They are used primarily to add the outputs of multiple High Power Amplifiers (HPA's), to construct high power signals that are then fed to radiating antennas for transmission of the signal. Improvements in power combiners are desirable.

The above information is presented as background information only to assist with an understanding of the present disclosure. No determination has been made, and no assertion is made, as to whether any of the above might be applicable as prior art with regard to the present invention.

SUMMARY

The need for high power microwave and millimeter wave sources for communications and RADAR applications has triggered the demand for advanced compact waveguide combiners, which offer high power handling capability, lower losses as well as compact size to further improve the microwave front ends. They also require high isolation levels (typically better than 20 dB) between input ports, to protect the individual input sources in the event of a failure. The present invention uses a new configuration of waveguide combiners using slotted six-port couplers to realize 3-way combiners with strong isolation between input ports, as a starting building block for 6-way, 9-way and multiples thereof with improved characteristics.

Various of the combiners disclosed herein, with the proposed method of construction, can be used in several applications. Various of the embodiments disclosed herein utilize the so called 3-way combiner. Various embodiments disclosed herein utilize air-filed metallic waveguide technology.

Some embodiments described herein provide a 3-way waveguide combiner, which is realized by terminating two internal ports of a six-port coupler using internal waveguide load elements.

Various embodiments described herein provide a 6-way waveguide combiner where the outputs of two 3-way combiners are combined using a short slot hybrid (2-way) waveguide combiner. The short slot hybrid can be implemented in the same plan level or can be routed into a different level, and it can be implemented to be in the same direction as the two 3-way combiners, or in the reverse direction compared to the two 3-way combiners. The manner in which the connection between the 3-way combiners and the 2-way combiner is made does not affect the operation of the 6-way combiner.

Some embodiments described herein provide a 9-way waveguide combiner where the outputs of three 3-way combiners are combined using a fourth (3-way) waveguide combiner.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

Figure 1A:
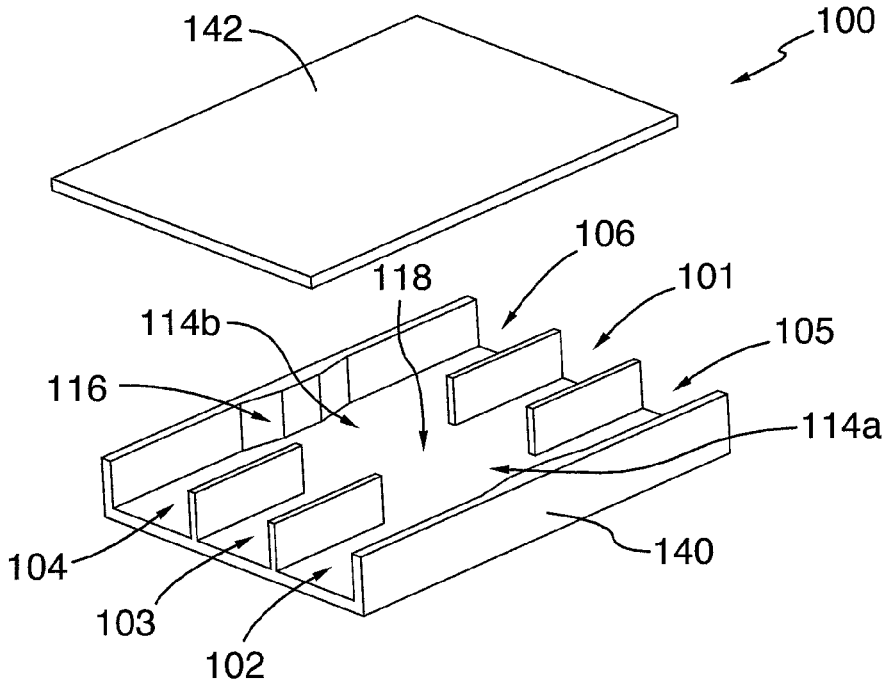
FIG. 1A illustrates an exploded perspective view of a six port compact waveguide coupler, according to an embodiment.

Various embodiments disclosed herein relate generally to methods of operation and construction of compact 3-way, 6-way and 9-way waveguide high microwave power combiners. Various of the power combiners disclosed herein exhibit superior isolation between input ports as compared to known combiners. Some of the combiners disclosed herein are intended for use with power amplifiers.

One problem associated with known power combiners is that losses and power handling capabilities limit the choices of power combiners used at very high power levels to waveguide technology. Waveguide combiners are usually realized in four distinct categories:

(I) Corporate scheme binary combiners, where the basic building block is a four port device, one of which, called the internal port, is terminated with a load that matches its own characteristic impedance and the other two are electrically isolated. One often used coupler is the short slot hybrid 3-dB waveguide coupler. This configuration maintains good isolation between input ports, especially in the event of a failure at one of the inputs. In such a case, power is diverted to the loads which terminate the internal ports rather than reflecting back to the other input sources thus giving an extra layer of protection in the event of failure. This configuration is however limited to be binary in nature, i.e. in powers of two (two, four, eight, sixteen, etc.). This in turn limits the designer's ability to address cases where power sources need the combining of a non-binary number of sources to produce certain power levels given other constraints such as volume, and overall efficiency. Various embodiments disclosed herein address this limitation by providing another building block that provides the designer with a much needed degree of freedom, with the 3-way combiner.

(II) Junction based combiners, where the basic building block is a bifurcation or a trifurcation of waveguide which is assisted by the use of dividing septa or irises. This solution is not limited to combining a binary number of sources, however it lacks the high levels of isolation between the input ports, offered in the case of corporate scheme binary combiners. In the case of any failures of any of the inputs, power is reflected back into the other inputs, thus endangering the power sources.

(III) Cavity based combiners, or radial combiners. This solution offers good isolation between their inputs. However the isolation between the inputs is proportional to the number of inputs, i.e. in order to achieve a reasonable isolation between the ports (e.g. 20 dB), the number of inputs must be 10 at least.

(IV) Travelling wave combiners. Where couplers with decreasing coupling ratios are cascaded and arranged in a specific order where a 3-dB (coupling ratio of 1 to 1) coupler is followed by a 4.78 (coupling ratio of 1 to 2) dB coupler which is in turn followed by a 6 dB (coupling ratio of 1 to 3) coupler, followed by a 7 dB coupler (coupling ratio of 1 to 4) and so forth. To realize a 3-way combiner requires two couplers, realizing four way combiners requires three couplers, etc. This arrangement solution offers moderate isolation between their inputs and as the coupling value becomes increasingly small, the realization of the couplers becomes more challenging. Practical consideration of manufacturing very thin walls and irises within the couplers result in rendering some of the couplers non practical.

Various embodiments of the present invention use a new configuration of six port couplers, which are utilized to realize 3-way combiners and multiples thereof, i.e. 6-way, 9-way, etc. Embodiments of the six-port coupler employ distinct features that, in some embodiments, provide superior functionality. Various embodiments of the six-port coupler are comprised of three adjacent waveguide sections with features (explained in detail below) that realize: matching of input and output ports, coupling between input ports and the output port, as well as isolation between input ports. In some embodiments, to address matching of the input ports tapered input sections are used to improve matching to standard waveguide ports of ports (102, 104, 105, and 106 as in FIG. 1A). In various other embodiments, this can also be achieved using stepped waveguide sections where the width of the waveguide is varied in discrete steps rather than a continuous taper, or using curved matching sections where the inputs waveguides are contoured to achieve the same goal. In some embodiments, matching of ports 101 and 103 (illustrated in FIG. 1A) is improved by varying the width a2 (illustrated in FIG. 1C) of these waveguide ports to differ from the widths a1 (illustrated in FIG. 1C) of the waveguides at ports 102, 104, 105, and 106 (illustrated in FIG. 1A). In various embodiments, the relationship between a1 and a2 is selected based on the frequency of operation and the required performance. The coupling is achieved using symmetrical slots (for symmetrical power split between input ports 102 and 104 as in FIG. 1A) or asymmetrical slots (for asymmetrical power split between input ports 102 and 104 as in FIG. 1A). As used herein, the term "asymmetrical slots" refers to slots that have asymmetrical widths. Generally, the slots are positioned symmetrically. In some embodiments, the slots are position asymmetrically. The physical dimensions of the two slots namely (t1, t2, w1, and w2 as in FIG. 1B) control the amount of energy that couples from each input port to the output port. Isolation between the input ports is also controlled by the physical dimensions of the coupling sections as well as the input sections. For example, by properly designing the input sections, reflected energy at the inputs are minimized and similarly, by properly designing the coupling sections almost all of the energy is coupled to the output port. This inherently results in minimum energy coupled to the isolated ports hence the isolation between the input and the isolated port is high. By terminating the two isolated ports in the 6-way coupler using internal wave guide loads, a 3-way combiner is realized. Using the 3-way combiner as a new building block, 6-way, and 9-way power combiners can be designed.

Various embodiments described herein relate to a waveguide coupler that includes a housing having a first outer waveguide branch, a second outer waveguide branch, and an inner waveguide branch; first, second, and third input ports at a first end of the housing in communication with the first outer, second outer, and the inner waveguide branches respectively; an output port at a second end of the housing in communication with the inner waveguide branch; a first wall separating the first outer waveguide branch and the inner waveguide branch, the first wall having a first iris; a second wall separating the second outer waveguide branch and the inner waveguide branch, the second wall having a second iris; a first tapered section in the first outer waveguide branch; and a second tapered section in the second outer waveguide branch.

In various embodiments, at least one of the first and second tapered sections includes a continuous taper, a curved section, or a series of stepped wave guide sections of varying width. In some embodiments, at least one of the tapered sections comprises a protrusion on an inner portion of the housing.

In various embodiments, each of the tapered sections can have either an increasing width when moving along the wave guide away from the input port (i.e. from the input port to the direction of the iris) or a decreasing width when moving along the wave guide away from the input port.

Various embodiments of the waveguide coupler are configured for radio-frequency waves, microwaves, or millimeter waves.

In some embodiments, the first wall and second wall have substantially the same thickness. In other embodiments, the first wall and second wall have different thicknesses.

In some embodiments, the first port and second port have substantially the same width while the third port has a different width. In some other embodiments, all three input ports have the same width. In yet other embodiments, all three input ports have different widths.

Some embodiments described herein relate to a 3-way combiner that includes any of the waveguide couplers described above with a waveguide load in each of the first and second outer waveguide branches, the waveguide load being at and end of the waveguide branch opposite the input ports.

Other embodiments described herein relate to 6-way combiners that includes two 3-way combiners as described above and two 2-way combiner. The output ports of each of the 3-way combiners are coupled to one of the input ports of the 2-way combiner.

Some embodiments described herein relate to a 9-way combiner that includes first, second, third, and forth 3-way combiners as described above. The output ports of the first, second, and third 3-way combiners are coupled to the first, second, and third output ports of the first, second and third input ports of the forth 3-way combiner.

Various embodiments described herein relate to a method of combining power. The method includes: receiving energy in each of a first, second, and third waveguide; terminating each of the first and second waveguides with a waveguide load; directing energy from the first waveguide into the third waveguide through a first iris; directing energy from the second waveguide into the third waveguide through a second iris; coupling the energy from each of the first, second, and third waveguides through the first and second irises; and outputting the coupled energy from the third waveguide.

FIG. 1A shows a three dimensional exploded perspective view of a six-port waveguide coupler 100, according to an embodiment. Waveguide coupler 100 has a housing 110, a cover 112, and six waveguide ports: port 101, port 102, port 103, port 104, port 105, and port 106. Ports 101 and 103 have width of a2 (see FIG. 1C). Ports 102, 104, 105, and 106 have width of a1 (see FIG. 1C). The housing 110 and cover 112 can be viewed as three branches of waveguides with two slots 114*a* and 114*b* that provide electromagnetic coupling between the different branches. Slots 114*a* and 114*b* may also be referred to as irises. Accordingly, the terms "slots" and "irises" will be used interchangeably herein. Generally, these terms are used to mean an opening in an intermediate wall. In some embodiments, such as those illustrated in FIGS. 1A, 1B and 1C, the irises extend the entire height of the walls. This represents a simple option for machining. In other embodiments, the irises can be either holes or apertures in the walls. In various embodiments, the slots are centered for a symmetrical response. However, other embodiments can utilize a design in which the slots are not centered for an asymmetrical response.

Coupler 110 also includes a tapered waveguide section 116 that provides a good matching between the coupling region 118 and the ports. The coupling region 118 includes the region between the two outer walls which includes the two irises 114*a* and 114*b* and the region between them. The irises facilitate interaction between adjacent waveguides and this interaction is referred to as coupling. In various embodiments, the use of tapered waveguide section 116 allows for better return losses. Tapered section 116 can be flared inward (i.e. the width reduces in the direction from the input port to where the iris is located) or outward (i.e. the width increases in the direction from the input port to where the iris is located). As noted above, tapered section 116 can include a continuous taper or can be implemented using stepped sections, which is similar in concept to approximating a ramp with a stair case. In some embodiments, the tapered waveguide section 116 is achieved by including protrusions on the inside wall of the housing. The particular design of tapered section 116 can depend on factors such as the frequency of interest and the waveguide that is used. In various embodiments of coupler 100, the housing 140 and a cover 142 are metallic.

Figure 1B:
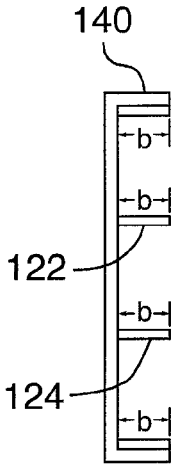
FIG. 1B illustrates a front view of the six port compact waveguide coupler of FIG. 1A with the cover removed.
Figure 1C:
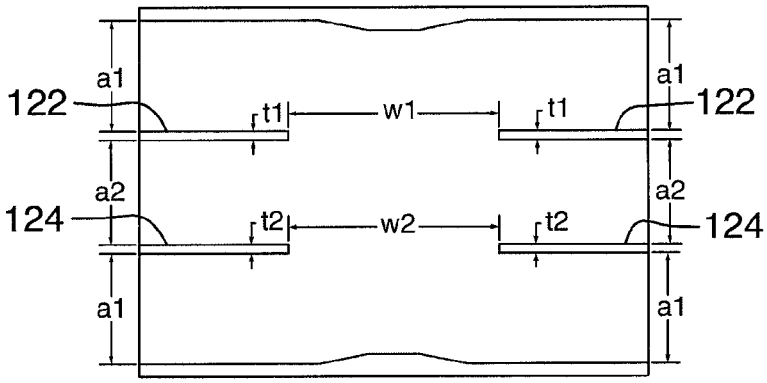
FIG. 1C illustrates a top plan view of the six port compact waveguide coupler of FIG. 1A with the cover removed.

FIG. 1B and FIG. 1C illustrate the front view and top view, respectively, of the six-port waveguide coupler of FIG. 1A without cover 112. FIG. 1B and FIG. 1C illustrate the metallic housing 110 of the six-port waveguide coupler 100 and show the three branches which are separated by metallic walls 122 and 124 of thicknesses t1 and t2, respectively. In various embodiments, t1 and t2 may have the same value or have different values. The top view also shows the irises 114*a* and 114*b* opened in the intermediate walls. Irises 114*a* and 114*b* have widths w1 and w2, respectively. In some embodiments, w1 and w2 have the same value; while, in other embodiments they have different values. In various embodiments, the structure maintains a constant height of all internal waveguide regions, the height is denoted b.

Figure 2:
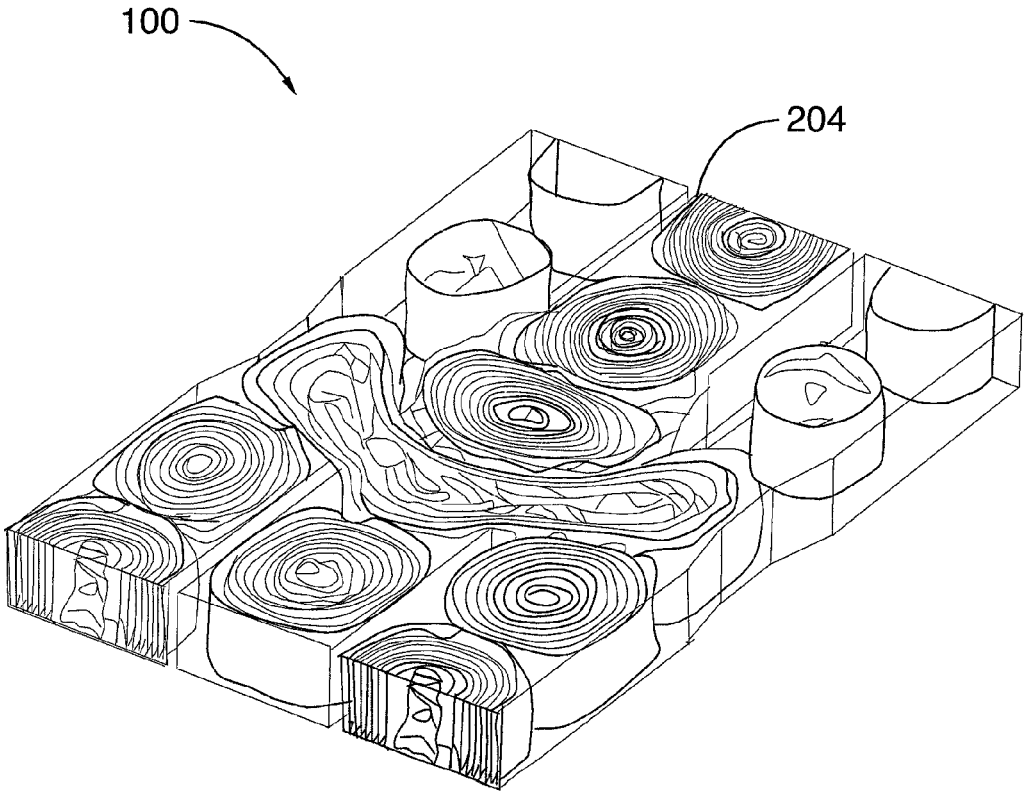
FIG. 2 illustrates an electric field intensity within the six port coupler of FIG. 1A.

FIG. 2 illustrates a three-dimensional plot of the electric field intensity 204 inside the six-port coupler 100 shown in FIG. 1A when the input ports are excited such that the input signals are combined at port 101. For example, in various embodiments, the relative phase between the input signals is controlled such that constructive addition of these signals takes place. FIG. 2 illustrates a total of three input signals applied to combiner 100, with one input signal applied to each of ports 102, 103, and 104. The combined signal emerges from port 101. As can be seen from FIG. 2, the signals delivered to ports 105 and 106 are very weak. Ports 105 and 106 may be referred to as isolated ports.

Figure 3:
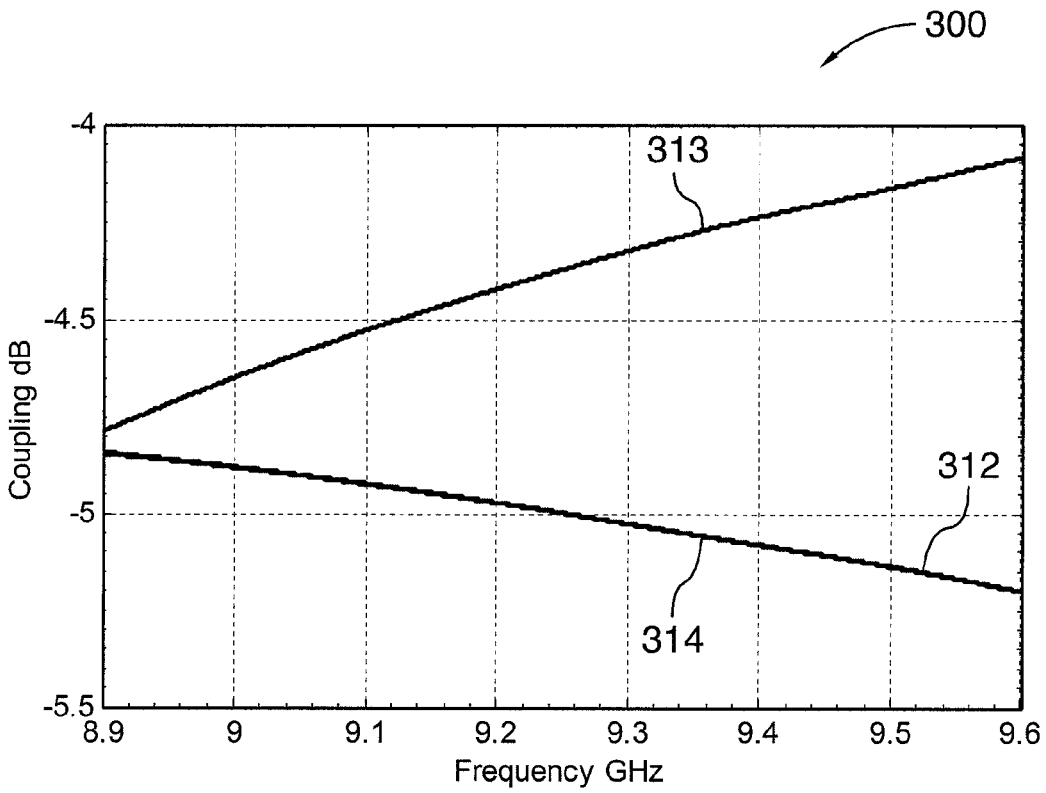
FIG. 3 illustrates a graph of scattering parameters representing the coupling between the input ports and the output port of coupler of FIG. 1A, according to an embodiment.

FIG. 3 illustrates a graph 300 of the scattering parameters that describe the coupling between each of the three input ports (ports 102, 103, and 104) and output port (port 101) of coupler 100 of FIG. 1A. FIG. 3 illustrates the case where t1=t2 and w1=w2. Plot 312 denotes the coupling between input port 102 and output port 101. Plot 313 denotes the coupling between input port 103 and output port 101. Plot 314 denotes the coupling between input port 104 and output port 101. The coupling between input port 102 and output port 101 is identical to the coupling between input port 104 and output port 101 due to the symmetry of the structure; however, this can be changed if desired by, for example, changing the widths of the irises and the thicknesses of the intermediate walls as described with reference to FIG. 1A above.

Figure 4:
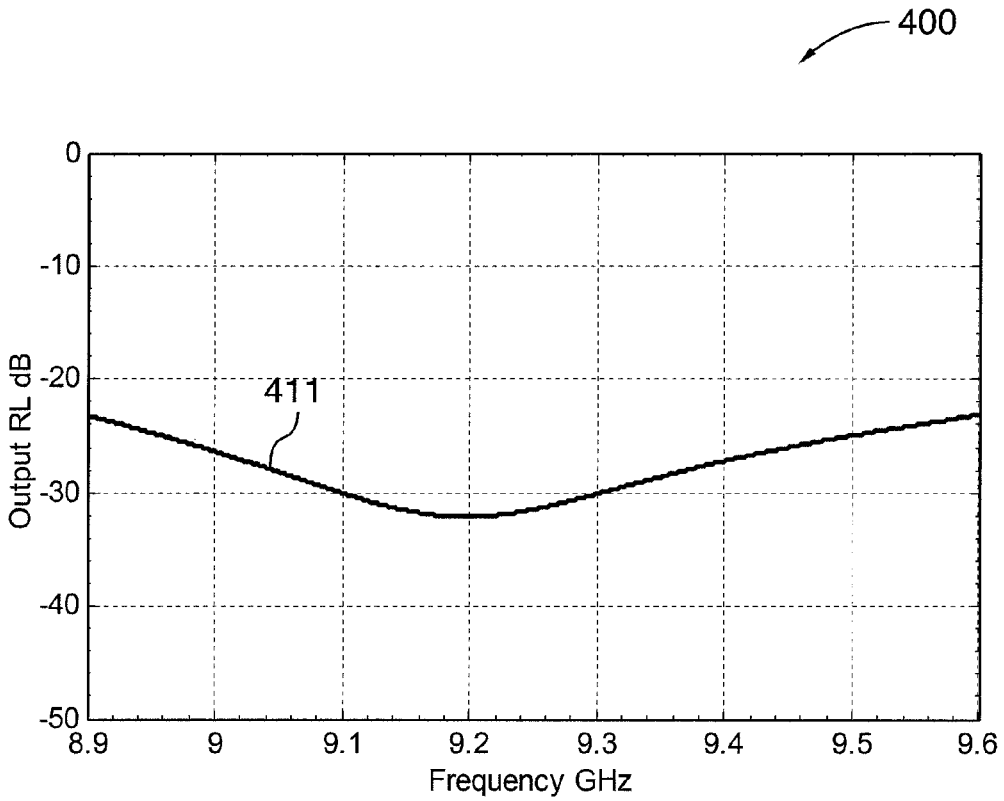
FIG. 4 illustrates a graph of scattering parameters representing the return loss at the output port of the six port coupler of FIG. 1A, according to an embodiment.

FIG. 4 illustrates a graph 400 comprising a plot 411 of the scattering parameters that describe the return loss at the output port (port 101) of coupler 100. Plot 411 shows that the structure of coupler 100 is well matched to the output port with return loss better than 20 dB across the frequency band of interest.

Figure 5:
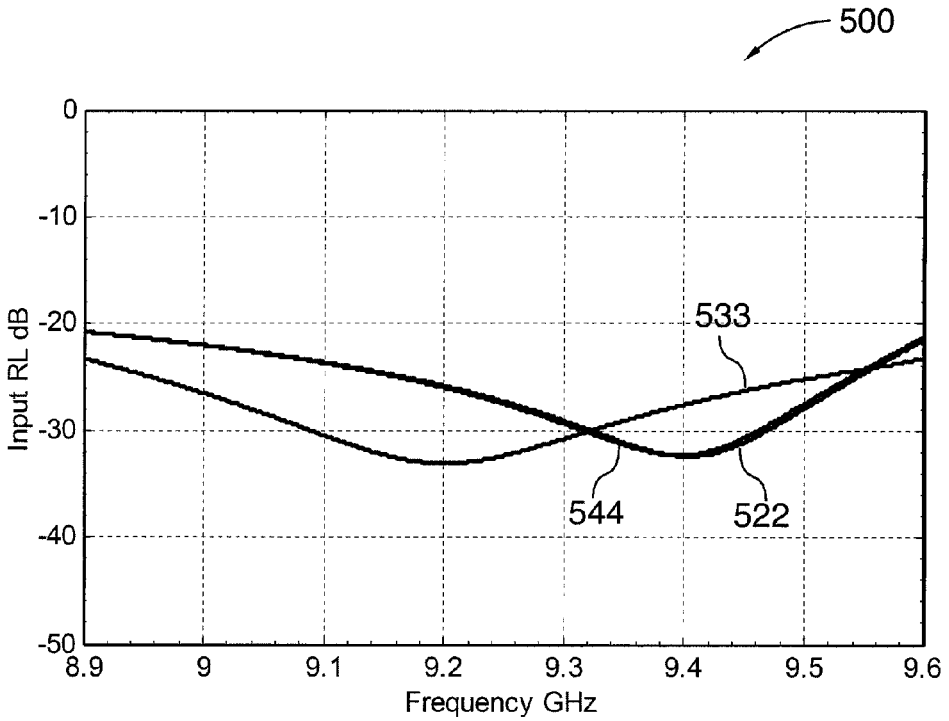
FIG. 5 illustrates a graph of scattering parameters representing the return loss at the input ports of the six port coupler of FIG. 1A, according to an embodiment.

FIG. 5 illustrates a graph 500 of the scattering parameters that describe the return loss at the input ports (ports 102, 103, and 104). Plots 522, 533, and 544 indicate the return losses for ports 102, 103, and 104, respectively. Graph 500 shows that the structure of coupler 100 is well matched to the input ports with return loss better than 20 dB across the frequency band of interest.

Figure 6:
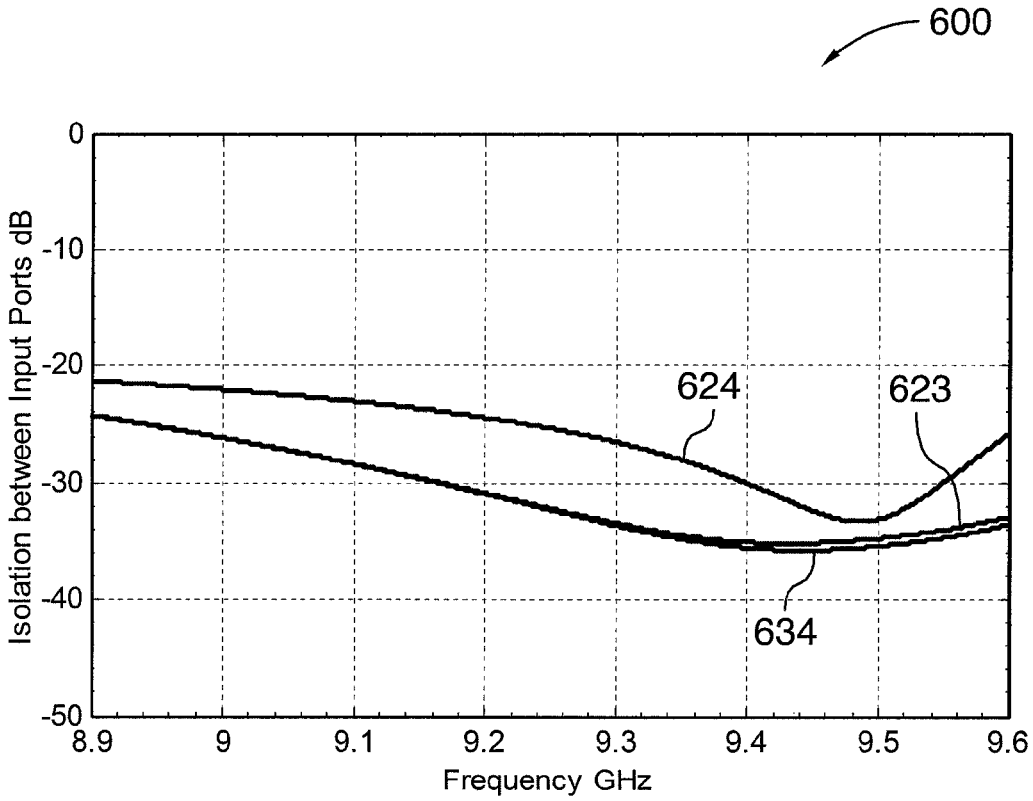
FIG. 6 illustrates a graph of scattering parameters representing the isolation between the input ports of the six port coupler of FIG. 1A, according to an embodiment.

FIG. 6 illustrates a graph 600 of the scattering parameters that describe the isolation between input ports (ports 102, 103, and 104). Plot 623 represents the isolation between ports 102 and 103. Plot 624 represents the isolation between ports 102 and 104. Plot 634 represents the isolation between ports 103 and 104. Graph 600 shows that the structure of coupler 100 provides strong isolation levels (better than 20 dB) between the individual inputs across the frequency band of interest.

Figure 7:
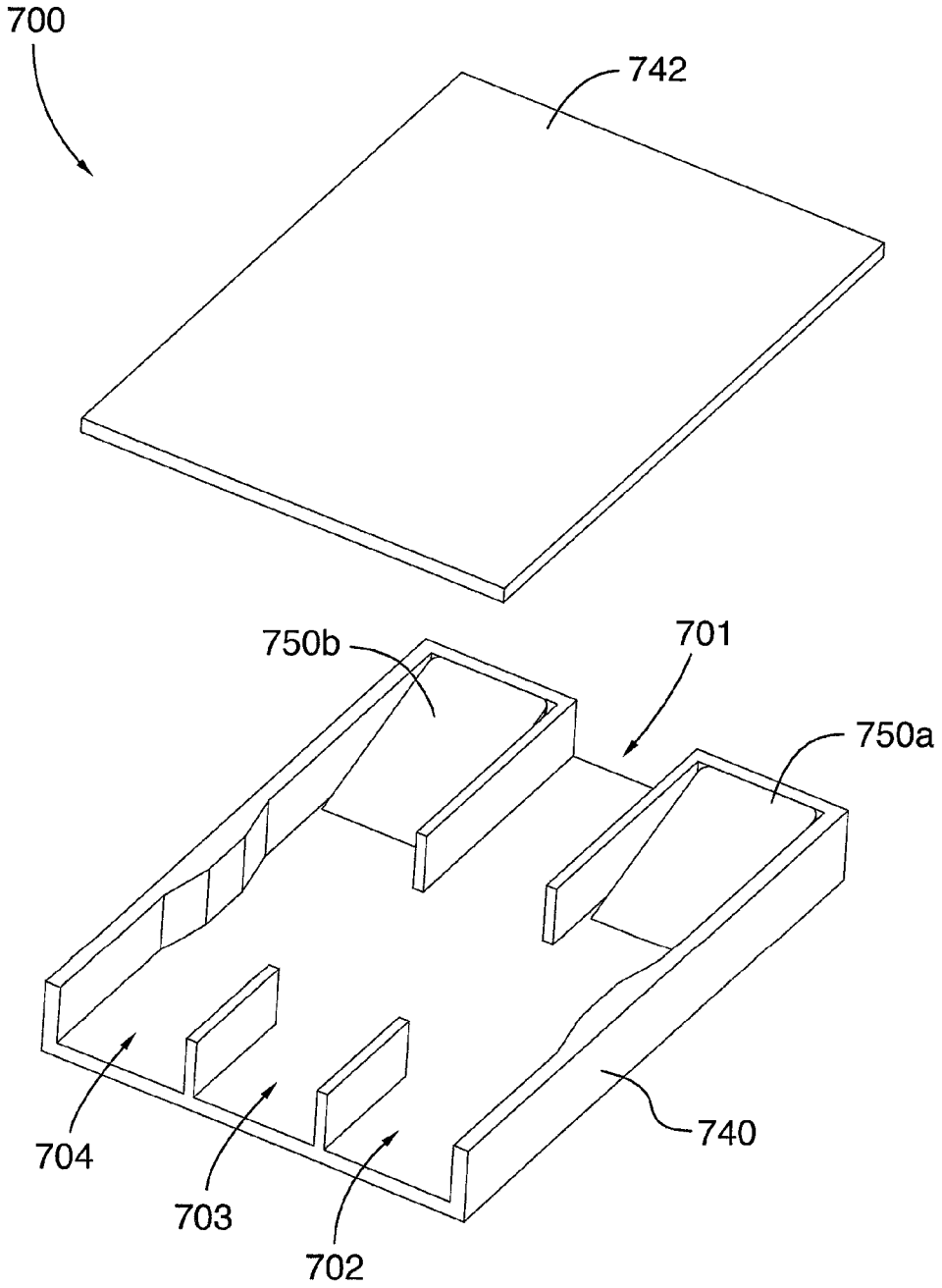
FIG. 7 illustrates an exploded perspective view of a 3-way combiner, according to an embodiment.

FIG. 7 shows a three dimensional exploded perspective view of a 3-way combiner 700, according to an embodiment. In various embodiments, combiner 700 is constructed by using the six-port waveguide coupler 100 of FIG. 1A and using two internal waveguide loads 750*a* and 750*b* that are used at the isolated ports (port 105 and port 106). Combiner 700 has four waveguide ports: 701, 702, 703, and 704. The width of the waveguide ports 701 and 703 is defined as a1. In various embodiments, combiner 700 is comprised of a metallic housing 740 and a cover 742 as well as the two internal loads (750*a* and 750*b*).

Figure 8:
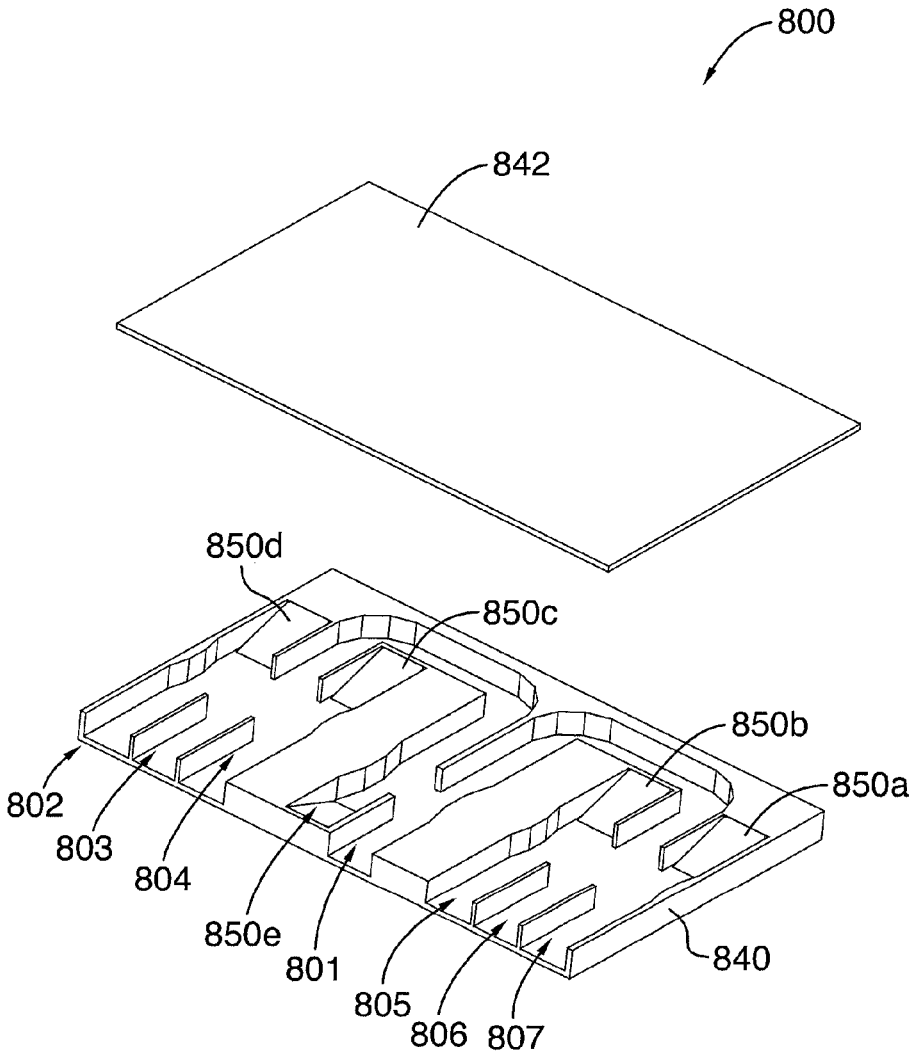
FIG. 8 illustrates an exploded perspective view of a 6-way combiner, according to an embodiment.

FIG. 8 shows a three dimensional exploded perspective view of a 6-way combiner, according to an embodiment. In various embodiments, it is constructed by combining the outputs of two 3-way combiners as in FIG. 7, through the use of a 2-way combiner. The structure has seven waveguide ports; an output port 801 and six input ports: 802, 803, 804, 805, 806, and, 807. The combiner uses five internal waveguide loads (850*a*, 850*b*, 850*c*, 850*d*, and 850*e*) that are used at the isolated internal ports of the two 3-way combiners as shown in FIG. 7. As well as the isolated internal port of the 2-way combiner used to combine the two outputs of the two 3-way combiners. In various embodiments, combiner 800 is comprised of a metallic housing 840 and a cover 842 as well as the five internal loads (850*a*, 850*b*, 850*c*, 850*d*, and 850*e*).

Figure 9:
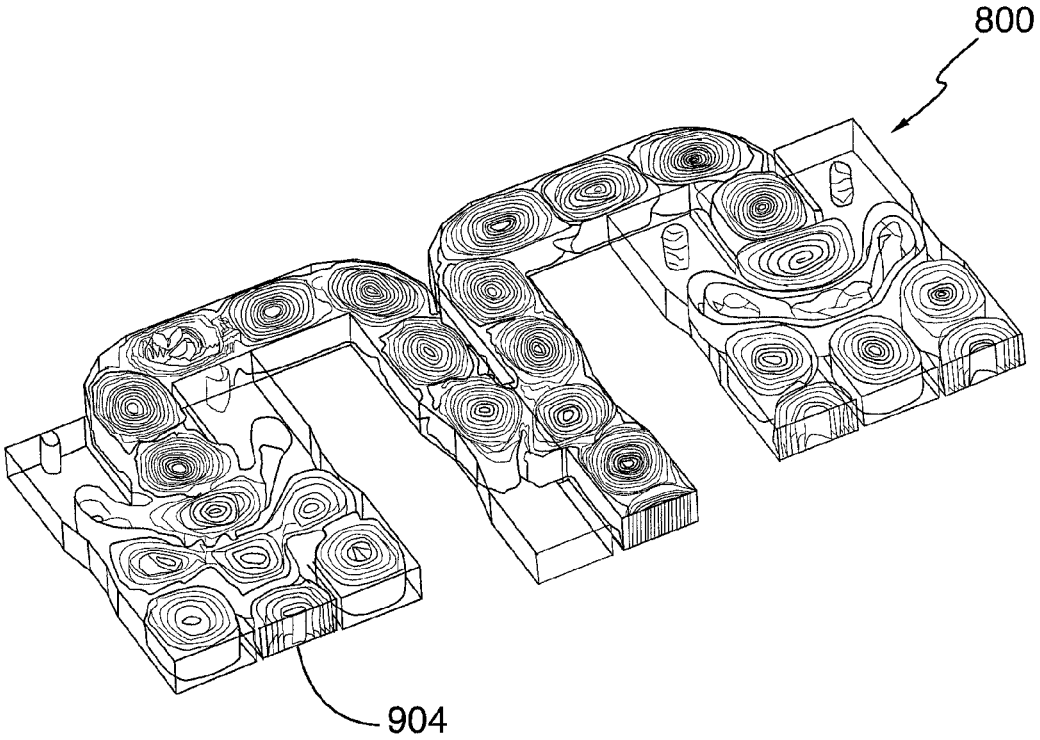
FIG. 9 illustrates an electric field intensity within the 6-way combiner of FIG. 8.

FIG. 9 illustrates a three-dimensional plot of the electric field intensity 904 inside the 6-way combiner 800 shown in FIG. 8. FIG. 9 illustrates a total of six input signals applied to combiner 800, with one signal being applied to each of ports 802, 803, 804, 805, 806, and 807. The combined signal emerges from port 801. As can be seen from FIG. 9, the signals delivered to internal waveguide loads 850*a*, 850*b*, 850*c*, 850*d*, and 850*e* (which are situated in the so called isolated ports) are very weak.

Figure 10:
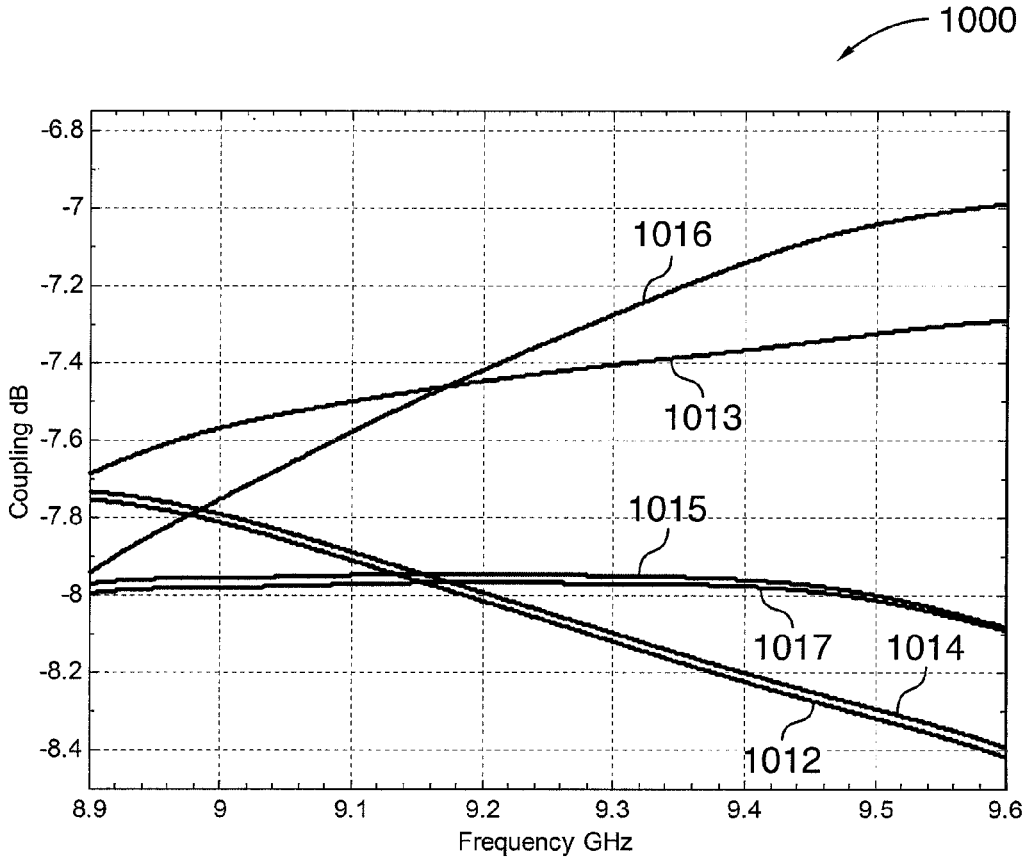
FIG. 10 illustrates a graph of scattering parameters representing the coupling between the input ports and the output port of the 6-way combiner of FIG. 8, according to an embodiment.

FIG. 10 illustrates a graph 1000 of the scattering parameters that describe the coupling between each of the six input ports (ports 802, 803, 804, 805, 806, and, 807) of combiner 800 illustrated in FIG. 8 and the output port (port 801). Plot 1012 denotes the coupling between input port 802 and output port 801. Plot 1013 denotes the coupling between input port 803 and output port 801. Plot 1014 denotes the coupling between input port 804 and output port 801. Plot 1015 denotes the coupling between input port 805 and output port 801. Plot 1016 denotes the coupling between input port 806 and output port 801. Plot 1017 denotes the coupling between input port 807 and output port 801.

Figure 11:
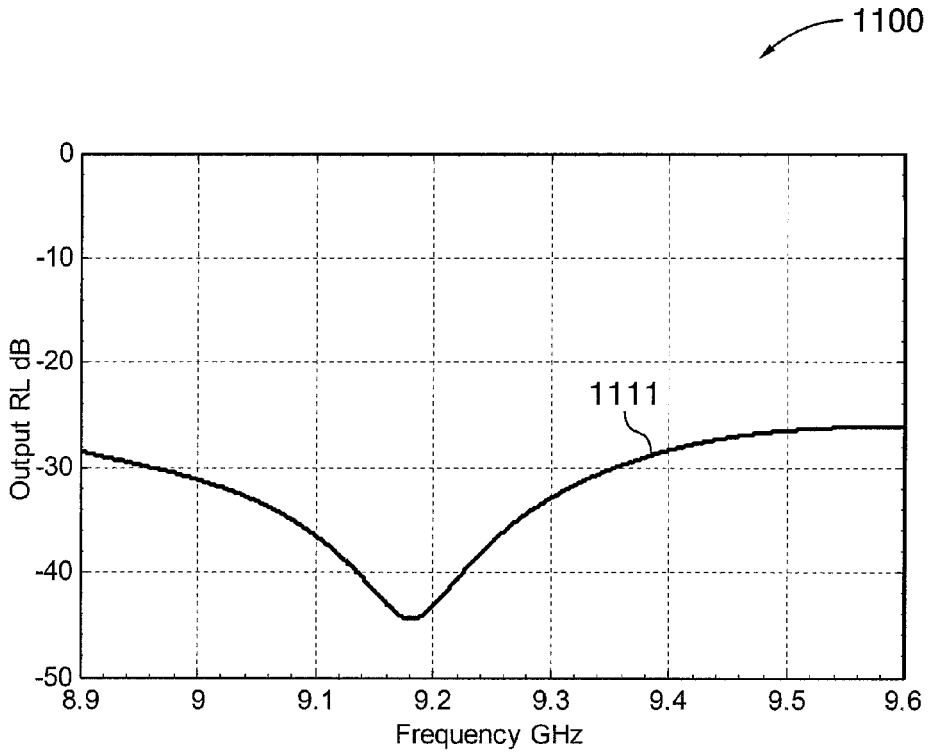
FIG. 11 illustrates a graph of scattering parameters representing the return loss at the output port of the 6-way combiner of FIG. 8, according to an embodiment.

FIG. 11 illustrates a graph 1100 comprising a plot 1111 of the scattering parameters that describe the return loss at the output port 801 of the 6-way combiner 800. Plot 1111 shows that the structure is well matched to the output port with return loss better than 25 dB across the frequency band of interest.

Figure 12:
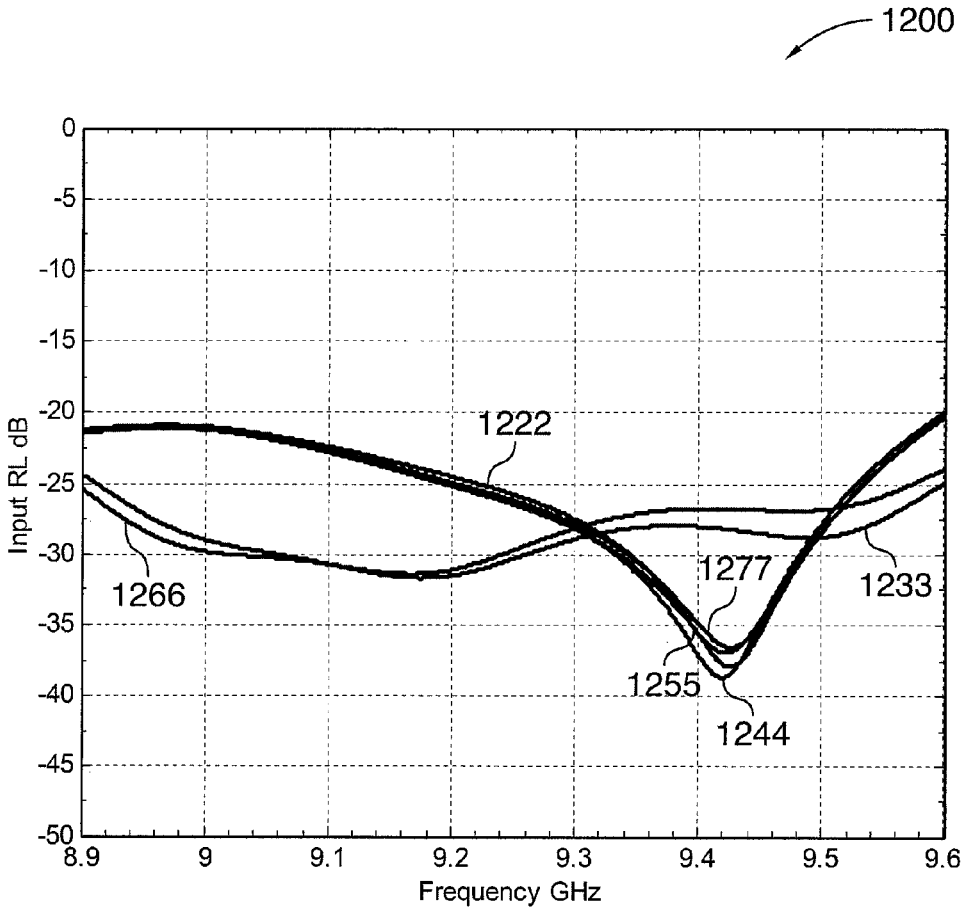
FIG. 12 illustrates a graph of scattering parameters representing the return loss at the input ports of the 6-way combiner of FIG. 8, according to an embodiment.

FIG. 12 illustrates a graph 1200 of the scattering parameters that describe the return loss at the input ports of the 6-way combiner 800 (ports 802, 803, 804, 805, 806, and, 807). Plots 1222, 1233, 1244, 1255, 1266, and 1277 indicate the return losses for ports 802, 803, 804, 805, 806, and, 807, respectively. Graph 1200 shows that the structure of combiner 800 is well matched to the input ports with return loss better than 20 dB across the frequency band of interest.

Figure 13:
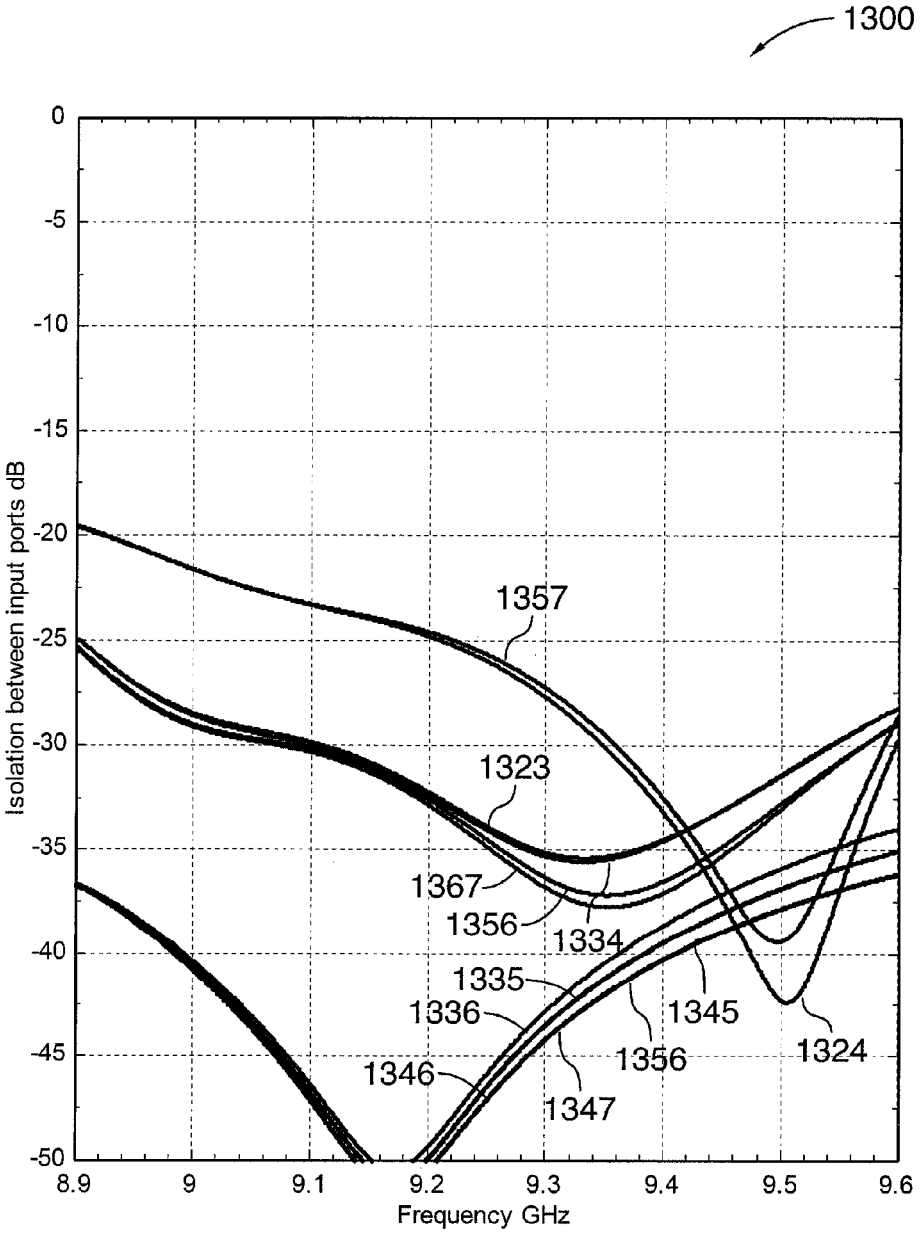
FIG. 13 illustrates a graph of scattering parameters representing the isolation between the input ports of the 6-way combiner of FIG. 8, according to an embodiment.

FIG. 13 illustrates a graph 1300 of the scattering parameters that describe the isolation between input ports of the 6-way combiner 800 (ports 802, 803, 804, 805, 806, and, 807). Plot 1223 represents the isolation between ports 1202 and 1203. Plot 1224 represents the isolation between ports 1202 and 1204. Plot 1225 represents the isolation between ports 1202 and 1205. Plot 1226 represents the isolation between ports 1202 and 1206. Plot 1227 represents the isolation between ports 1202 and 1207. Plot 1234 represents the isolation between ports 1203 and 1204. Plot 1235 represents the isolation between ports 1203 and 1205. Plot 1236 represents the isolation between ports 1203 and 1206. Plot 1237 represents the isolation between ports 1203 and 1207. Plot 1245 represents the isolation between ports 1204 and 1205. Plot 1246 represents the isolation between ports 1204 and 1206. Plot 1247 represents the isolation between ports 1204 and 1207. Plot 1256 represents the isolation between ports 1205 and 1206. Plot 1257 represents the isolation between ports 1205 and 1207. Plot 1267 represents the isolation between ports 1206 and 1207. Graph 1300 shows that the structure provides strong isolation levels (better than 20 dB) between the individual inputs across the frequency band of interest.

Figure 14:
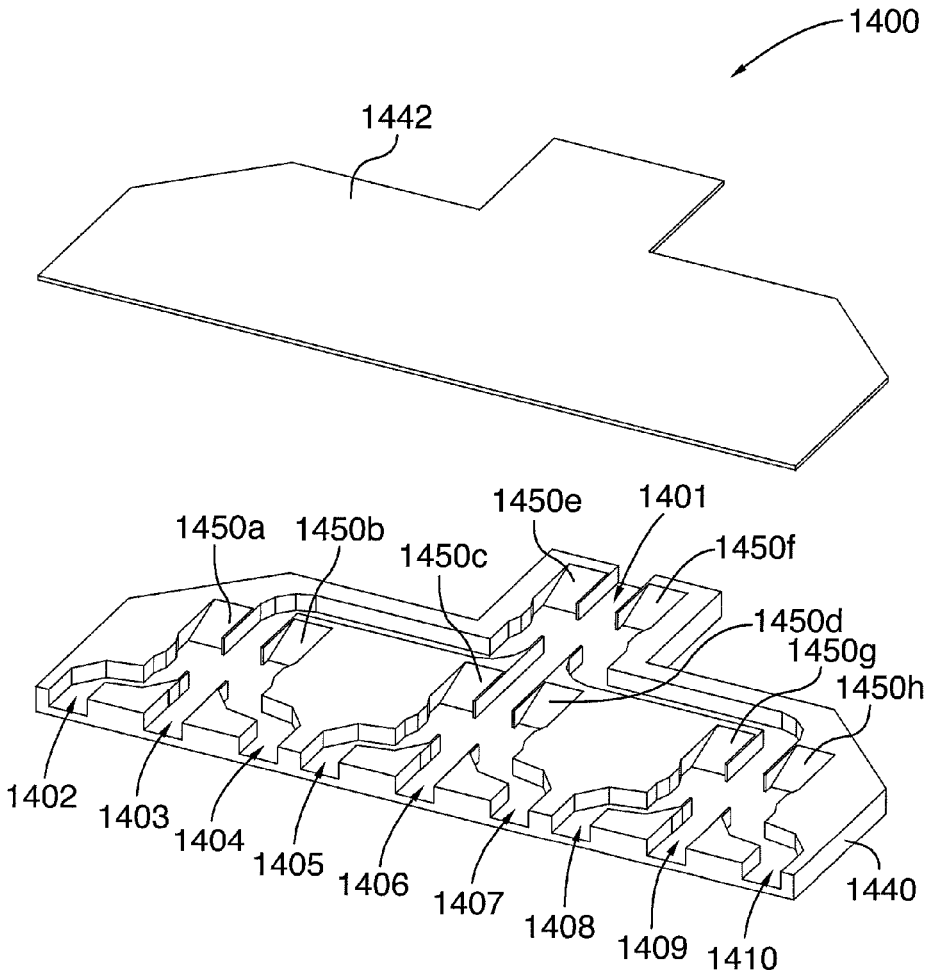
FIG. 14 shows an exploded perspective view of a 9-way combiner, according to an embodiment.

FIG. 14 shows a three dimensional exploded perspective view of a 9-way combiner 1400, according to an embodiment. In various embodiments, combiner 1400 is constructed by combining the outputs of three 3-way combiners 700 of FIG. 7, through an additional 3-way combiner 700. Combiner 1400 has ten waveguide ports; an output port 1401 and nine input ports: 1402, 1403, 1404, 1405, 1406, 1407, 1408, 1409, and 1410. Combiner 1400 includes eight internal waveguide loads: 1450*a*, 1450*b*, 1450*c*, 1450*d*, 1450*e*, 1450*f*, 1450*g*, and 1450*h* that are used at the isolated internal ports of the four 3-way combiners as in FIG. 7. In various embodiments, combiner 1400 is comprised of a metallic housing 1440 and a cover 1442.

In the preceding description, for purposes of explanation, numerous details are set forth in order to provide a thorough understanding of the embodiments. However, it will be apparent to one skilled in the art that these specific details are not required. The above-described embodiments are intended to be examples only. Alterations, modifications and variations can be effected to the particular embodiments by those of skill in the art without departing from the scope, which is defined solely by the claims appended hereto.

The invention claimed is:

1. A waveguide coupler comprising:

a housing having a first outer waveguide branch, a second outer waveguide branch, and an inner waveguide branch;

first, second, and third input ports at a first end of the housing in communication with the first outer, second outer, and the inner waveguide branches respectively;

a first output port defined, at a second end of the housing, by the first outer waveguide branch;

a first wall separating the first outer waveguide branch and the inner waveguide branch, the first wall having a first iris;

a second wall separating the second outer waveguide branch and the inner waveguide branch, the second wall having a second iris;

a first tapered section in the first outer waveguide branch; and a second tapered section in the second outer waveguide branch, wherein:

the first iris has a slot width, the second outer waveguide branch defines a second output port having a second output port width equal to the slot width, and the inner waveguide branch defines a third output port having a third output port width different than the slot width.

2. The waveguide coupler of claim 1, wherein at least one of the first and second tapered sections comprises a continuous taper.

3. The waveguide coupler of claim 1, wherein at least one of the first and second tapered sections comprises a curved section.

4. The waveguide coupler of claim 1, wherein at least one of the first and second tapered sections comprises a series of stepped wave guide sections of varying width.

5. The waveguide coupler of claim 1, wherein at least one of the first and second tapered sections comprises a protrusion on an inner portion of the housing.

6. The waveguide coupler of claim 1 wherein at least one the first tapered section and the second tapered section has an increasing width from the input port to the iris.

7. The waveguide coupler of claim 1 wherein the at least one tapered section has a decreasing width from the input port to the iris.

8. The waveguide coupler of claim 1, wherein the waveguide coupler is configured for radio-frequency waves.

9. The waveguide coupler of claim 1, wherein the waveguide coupler is configured for microwaves.

10. The waveguide coupler of claim 1, wherein the waveguide coupler is configured for millimeter waves.

11. The waveguide coupler of claim 1, wherein the first wall has a first thickness at the first iris; and wherein the second wall has a second thickness at the second iris; and further wherein the first thickness is substantially equal to the second thickness.

12. The waveguide coupler of claim 1, wherein the first wall has a first thickness at the first iris; and wherein the second wall has a second thickness at the second iris; and further wherein the first thickness is different than the second thickness.

13. The waveguide coupler of claim 1, wherein the first input port has a first input port width, the second input port has a second input port width; and the third input port has a third input port width; and wherein each of the first, second, and third input port widths are different from each other.

14. The waveguide coupler of claim 1, wherein the first input port has a first input port width, the second input port has a second input port width; and the third input port has a third input port width, and wherein the first, second, and third input port widths are substantially the same.

15. The waveguide coupler of claim 1, wherein the first input port has a first input port width, the second input port has a second input port width; and the third input port has a third input port width, and wherein the first and second input port widths are substantially the same; and wherein the third input port width is different than the first and second input port widths.

16. A 3-way combiner comprising:

the waveguide coupler of claim 1; and a waveguide load formed in each of the first and second outer waveguide branches, at the first output port and the second output port respectively.

17. A 6-way combiner comprising:

a first 3-way combiner according to claim 16;

a second 3-way combiner according to claim 16; and a two way combiner having first and second input ports and an output port;

wherein the output port of the first 3-way combiner is coupled to the first input port of the two way combiner and the output port of the second 3-way combiner is coupled to the second input port of the two way combiner.

18. A 9-way combiner comprising:

first, second, third, and fourth 3-way combiners according to claim 16;

wherein the output ports of the first, second, and third 3-way combiners are coupled to the first, second, and third output ports of the first, second and third input ports of the fourth 3-way combiner.

19. A method of combining power, the method comprising:

receiving energy in each of a first, second, and third waveguide;

terminating each of the first and second waveguides with a waveguide load;

directing energy from the first waveguide into the third waveguide through a first iris;

directing energy from the second waveguide into the third waveguide through a second iris;

coupling the energy from each of the first, second, and third waveguides in a coupling region, the coupling region being a region between two outer walls which includes the first and second irises and a region between them; and outputting the coupled energy from the third waveguide.

* * * * *